United States Patent [19]

Bosch

[11] 4,014,250

[45] Mar. 29, 1977

[54] CYLINDER BLOCK POSITIONING ARRANGEMENT FOR A HYDRAULIC AXIAL PISTON MACHINE

[75] Inventor: Paul Bosch, Ludwigsburg, Germany

[73] Assignee: Robert Bosch G.m.b.H., Stuttgart, Germany

[22] Filed: Mar. 31, 1972

[21] Appl. No.: 240,253

[30] Foreign Application Priority Data

Apr. 5, 1971 Germany ..... 2116619

[52] U.S. Cl. ..... 91/487; 91/507; 92/57; 92/86

[51] Int. Cl.[2] ..... F01B 1/22

[58] Field of Search ..... 92/12.2, 57, 86, 126, 92/167, 127; 91/485, 487, 507

[56] References Cited

UNITED STATES PATENTS

| | | | |
|---|---|---|---|
| 2,383,093 | 8/1945 | Wahlmark | 92/12.2 X |
| 3,011,453 | 12/1961 | Budzich | 91/485 X |
| 3,046,906 | 7/1962 | Budzich | 91/487 X |
| 3,117,420 | 1/1964 | Young | 92/12.2 X |
| 3,255,673 | 6/1966 | Thoma | 91/485 X |
| 3,465,680 | 9/1969 | Saila | 92/12.2 X |
| 3,587,403 | 6/1971 | Connett | 91/507 |
| 3,657,970 | 4/1972 | Kobayashi et al. | 91/487 X |
| 3,693,508 | 9/1972 | Chondzinski | 92/57 X |

FOREIGN PATENTS OR APPLICATIONS

| | | | |
|---|---|---|---|
| 1,285,891 | 12/1968 | Germany | 92/12.2 |

*Primary Examiner*—Martin P. Schwadon
*Assistant Examiner*—Abraham Hershkovitz
*Attorney, Agent, or Firm*—Michael J. Striker

[57] ABSTRACT

In a hydraulic axial piston machine, which may be a pump or hydraulic motor, whose cylinders are located on a larger circle than the cylinder ports and the stationary high pressure and low pressure ports of a stationary body, a tilting moment is exerted on the cylinder block which is compensated by radial pressure exerted on the cylinder block by positioning cylinder and piston members operated either directly by high pressure fluid from the high pressure conduit of the stationary body, or indirectly under the control of a valve operated by leakage fluid obtained from a recess in the control face of the stationary body.

14 Claims, 4 Drawing Figures

CYLINDER BLOCK POSITIONING ARRANGEMENT FOR A HYDRAULIC AXIAL PISTON MACHINE

BACKGROUND OF THE INVENTION

The present invention is concerned with an axial piston machine, pump or hydraulic motor, with a rotary cylinder block having a block end face cooperating with a stationary control face having high pressure and low pressure control ports arranged along a circle having a radius which is smaller than the radius of the circle along which the cylinders are arranged. When the clyinder block end face and the control face of the stationary body are pressed against each other, the cylinder ports and the high pressure and low pressure ports communicate, but a certain leakage is unavoidable.

The U.S. Pat. No. 907,737 discloses an axial piston motor in which the cylinders are arranged along a circle which is greater than the circle along which the inlet and outlet control ports are located. The diameter of the circles of the ports is substantially smaller than the diameter of the circle on which the cylinders are located. Three axially effective adjusting screws hold the stationary and rotary parts together. It is a disadvantage of this motor that the forces acting in the cylinders on the cylinder block have a greater radial distance from the rotor axis than the opposing forces exerted by the ports on the cylinder block. The result is that different opposing moments act on the cylinder block which causes tilting of the cylinder block. When the cylinder block end face is thus tilted relative to the stationary control face, great leakage occurs. The leakage can be somewhat reduced by tightening the adjusting screws which press the cylinder block against the control face of the stationary body, but the friction between the engaging faces is increased, and the efficiency reduced.

The German A.S. 1,285,891 discloses apparatus for hydraulically pressing the stationary body with its control face against the cylinder block end face of an axial piston machine. In this machine, the ports are also arranged along a smaller circle than the cylinders so that a tilting moment acts on the cylinder block. The sealing between the cylinder block end face and the stationary control face is improved by providing a piston shaped projection on the side of the stationary body remote from the cylinder block, which moves in a corresponding cylinder receiving fluid under pressure so that the stationary body with its control face is pressed into sealing contact with the cylinder body end face. This construction has the same disadvantage as the other described machine according to the prior art, since stable running of the rotor can be obtained only by increasing the axial pressure which causes undesirable friction and wear.

SUMMARY OF THE INVENTION

It is an object of the invention to provide an axial piston hydraulic machine in which even at very high operational pressures, no sealing problems occur.

Another object of the invention is to provide a hydraulic axial piston machine in which a tilting moment acting on the cylinder block is compensated.

Another object of the invention is to provide positioning means acting on the cylinder block in radial direction for compensating the tilting moment exerted on the cylinder block.

With these objects in view, the present invention provides positioning means for radially supporting the cylinder block near the block end face thereof. This has the advantage that a tilting of the cylinder block end face relative to the stationary control face, and thereby a larger gap between the cylinder block end face and the control face are prevented even at very high fluid pressures.

It is particularly advantageous if the cylinder block end face is in contact with the stationary control face only along a projecting annular control face portion in which the control ports are provided, since in such an arrangement, the cylinder block can freely adjust to the position of the control face. Due to the omission of conventional slide rings on the control face, a statically indeterminate abutment of the cylinder block end face on the control face can be avoided, and the cylinder block end face can be easily held in sealing contact with the projecting control face portions in which the control ports are located. This is also true when the projecting control face portions have been worn off by friction or erosion due to dirt particles in the pressure fluid or liquid.

The radially acting supporting force of the positioning means can be particularly favorably adapted to different operational conditions of the hydraulic machine if the piston of the positioning means is subjected to a control pressure.

In one embodiment of the invention, the cylinder of the positioning means is directly connected with the high pressure conduit of the stationary body. In another embodiment of the invention, a control valve controls the flow from the high pressure inlet means of the stationary body into the cylinder of the positioning means, and is operated in accordance with the leakage flow occurring between the cylinder block end face and the control face in which the high pressure ports and low pressure ports are provided.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
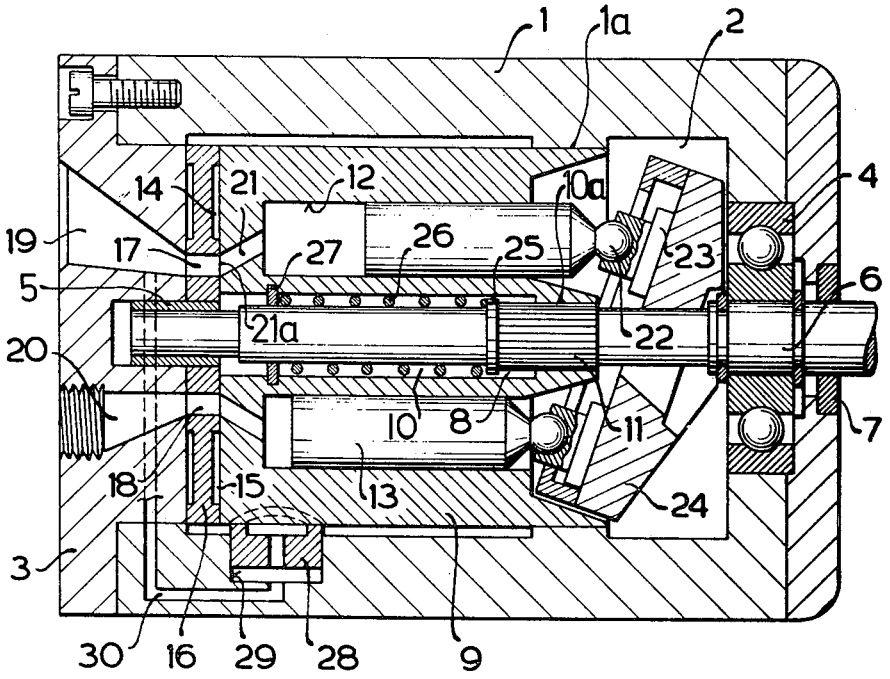
FIG. 1 is an axial sectional view illustrating a first embodiment of the invention.

Referring first to FIG. 1, the pot-shaped housing 1 of an axial piston pump has an inner space 2, closed by a cover 3 and supporting a roller bearing 4 on the bottom of the housing 1, while a blind bore in the cover 3 is used as a second bearing for a shaft 6, one end of which projects through an opening in the bottom wall of the housing which is sealed by a sealing ring 7.

Drive shaft 6 has a portion of greater diameter provided with splines which are preferably teeth 8. In the cavity 2 of the housing, a cylinder block 9 is located which has a central bore 10 through which drive shaft 6 passes. Bore 10 has an end portion 10a of smaller diameter provided with inner teeth engaging the teeth 8 of shaft 6. Substantially in the same plane transverse to shaft 6, an annular inner surface 1a is provided in the housing 1 along which the cylinder block 9 is slidingly guided. Cylinder block 9 has at the other end thereof an end face 14 slidingly engaging a stationary control face 15 of a stationary plate 16 which is fixedly secured to, and forms part of the stationary body 3.

Figure 3:
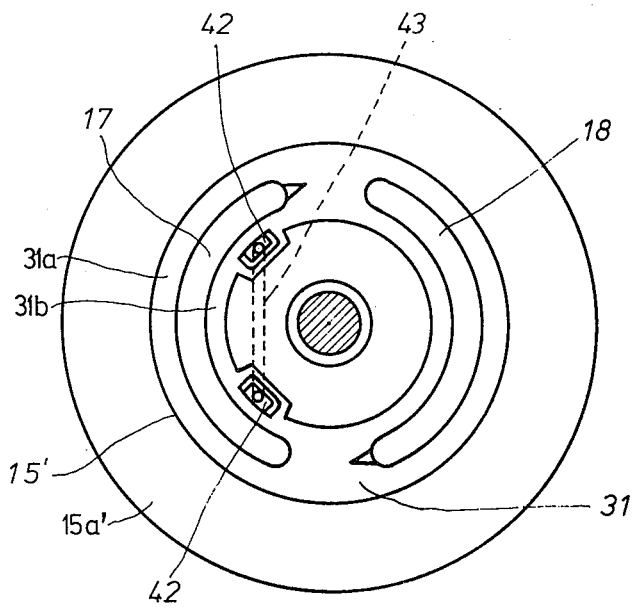
FIG. 3 is an end view at the control face taken in FIG. 2 in the direction of the arrow III.
Figure 4:
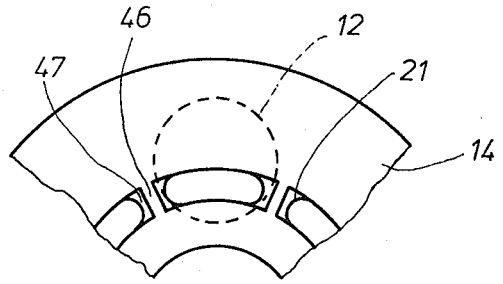
FIG. 4 is a fragmentary end view illustrating a preferred construction of the cylinder block end face and of the cylinder ports thereon.

The stationary plate 16 is provided with two part-circular high pressure and low pressure ports 17 and 18, substantially as shown in FIG. 3 which, however, shows other elements which are not part of the embodiment of FIG. 1.

A plurality of cylinders are provided in the cylinder block 9 along a circle which has its center in the axis of shaft 6. Pistons 13 are slidingly and sealingly guided in the cylinders 12, and have spherical heads 22 mounted in spherical seats of slide shoes 23 which are in contact with an annular swash plate 24 through which drive shaft 6 passes. For the sake of clarity, swash plate 24 is shown in the drawing turned an angle of 90°.

A spring ring 25 abuts a shoulder formed by the teeth 8 on which a coil spring 26 abuts which surrounds shaft 6. The other end of spring 26 abuts a spring ring secured to the wall of the central bore in cylinder block 9.

The cover or stationary body 3 has a high pressure inlet conduit 19 and a low pressure inlet conduit 20 respectively opening into the part-circular high pressure and low pressure ports 17 and 18 which are arranged along a circle having the same radius as the cylinder ports 21*a* of slanted passages 21 which are connected with the cylinders 12. The cylinders 12, however, are located along a circle having a larger diameter than the circle formed by the control ports 17 and 18 and the cylinder ports 21*a*.

The housing 1 is provided with a positioning cylinder 29 in which a positioning piston 28 is movable in radial direction in relation to the axis of shaft 6 and of the rotary cylinder block 9. A high pressure conduit 30 connects the chamber formed in cylinder 29 by the positioning piston 28 with the high pressure conduit 19 so that positioning piston 28 is urged against the cylinder block 9 near the cylinder block end face 14. Positioning piston 28 has a duct connecting the pressure chamber with a recess on its end face for providing a fluid cushion betwen positioning piston 28 and the outer surface of cylinder block 9.

The positioning means 29, 28 is diametrically disposed to the high pressure control port 17, but located in the same axial plane, which is the plane of the drawing.

If several positioning means 28, 29 are used, the resultant force of positioning pistons 28 must act in the same plane in which the pressure produced by high pressure port 17 is located.

It is advantageous that the radius of the circle on which the control ports 17, 18 are located is smaller than the radius of the circle along which the cylinders 12 are disposed, since the cylinder block ports 21*a* have to move a shorter circumferential distance as compared with an arrangement in which the control ports 17 and 18 are arranged on a circle having the same radius as the circle along which the cylinders 12 are located. The smaller circle of the ports reduces the resistance against the flow through the ports into the cylinder passages 21, so that better filling of the cylinders 12 is obtained.

However, due to the different radii of the surface of the ports and of the cylinders, the resultant pressure force produced by all cylinders 12 acts at a different radial distance than the resultant pressure force produced in the cylinder ports 21*a*, and acting on the cylinder end face 14. As a result, a moment is produced which tends to tilt the cylinder block 9 with its cylinder block end face 14 relative to the stationary control surface 15. This tilting moment is directly proportional to the pressure prevailing in the machine. The pressure from the high pressure conduit 19 is transmitted through connecting conduit means 30 to the positioning cylinder 29 so that positioning piston 28 is pressed with a force depending on the pressure in the high pressure conduit 19 against the cylinder block 9 near the cylinder end face 14 so that the tilting moment is counteracted, and the cylinder block 19 is straightened until the faces 14 and 15 are parallel. Due to the fact that positioning piston 28 acts in radial direction transverse to the axial pressure acting on the cylinder block 9, the force pressing cylinder block end face 14 against control face 15 is not increased.

Figure 2:
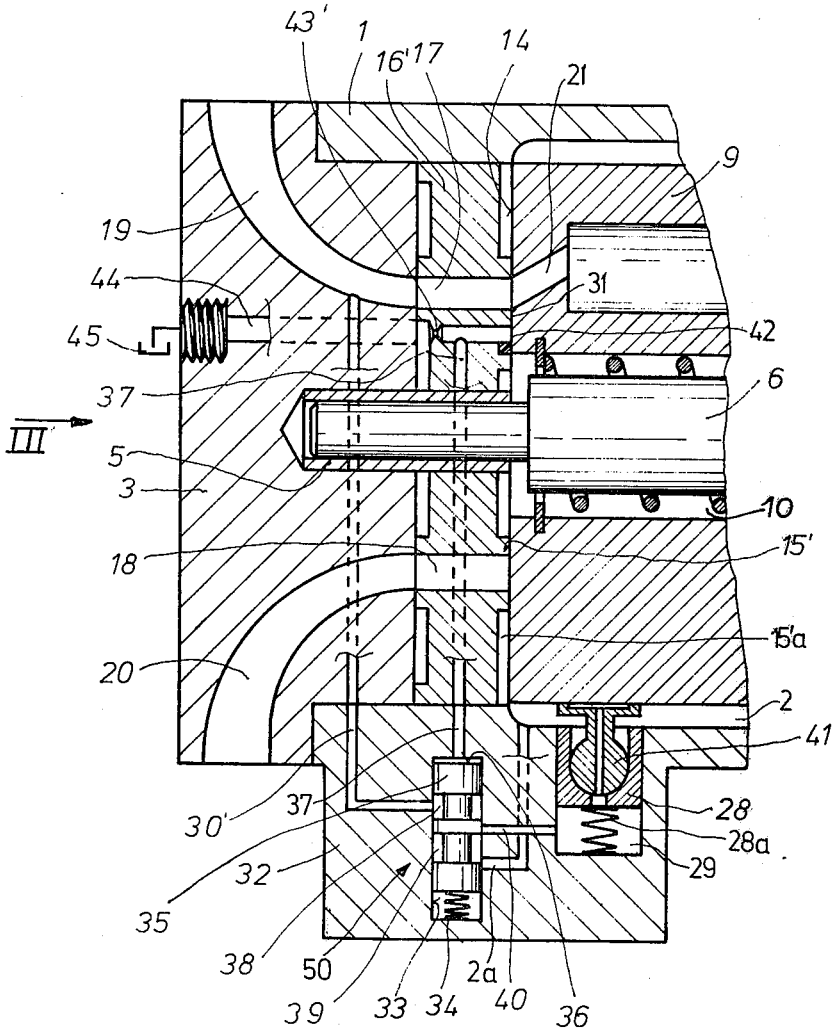
FIG. 2 is a fragmentary axial view illustrating a second embodiment of the invention.

Referring now to the second embodiment of the invention illustrated in FIGS. 2 and 3, in which corresponding parts are indicated by the same reference numerals as in FIG. 1, the cylinder block 9 is rotatably mounted in the housing 1 and has a cylinder block end face 14 slidingly engaging the control face 15′ of the stationary body 3, 16′, the plate 16′ being fixedly secured to cover 3. As best seen in FIG. 3, the control face 15 has an annular radially projecting control face portion 31 which is slidingly engaged by the cylinder block end face 14, and has the high pressure and low pressure ports 17 and 18 arranged in such a position that outward and inward of the control ports 16 and 18, two sealing faces 31*a* and 31*b* remain. Although the outer portion 15′*a* of control face 15′ is not in contact with the cylinder block end face 14, it is not provided with slide rings, as in prior art constructions so that the cylinder block 9 can freely adjust its position in accordance with the cooperating faces 14 and 31. A control valve 50, and positioning means 28, 29 are provided in a support part 32 integral with the housing 1 and secured to the stationary body 3, 16′. Control valve 50 has a valve slide 35 slidingly and sealingly guided in a cylinder bore 33, and biased by a spring 34 in one direction. Spring 34 is located in an end chamber and abuts one end face of the valve cylinder 33 so as to reduce the volume of the end chamber at the other end of valve cylinder 33 which is bounded by the end face 36 of the valve slide 35. Valve slide 35 has two annular chambers 38, 39. The annular chamber 39 is connected with the interior cavity 2, or with some other low pressure space, by a conduit 2*a*. The other annular chamber 38 has an inlet connected with the high pressure means 19 by a conduit 30′. An outlet conduit 40 connects, depending on the position of the valve slide 35, one of the annular chambers 38, 39 with the chamber formed in positioning cylinder 29 by positioning position 28 which is urged by a spring 28*a* to engage with a slide shoe 41 the outer surface of cylinder block 9 the cylinder end face 14. Slide shoe 41 may have a pressure area supplied with fluid through a conduit passing through the positioning piston 28.

As best seen in FIG. 3, within the a region bounded by part circular high-pressure control port 17, two pocket shaped recesses 42 are provided near the ends of the curved control port 17 and inward of the same, to receive leakage flow flowing across the control face portion 31*b*. The recesses 42 are tightly closed by elastic sealing means in circumferential and inward and radial directions. The recesses 42, which are connected by conduit 43, discharge the leakage flow into a connecting conduit 37 shown in FIG. 2, which is connected with one end chamber of valve slide 35. Connecting conduit 37 communicates with a discharge conduit 44 opening in the reservoir 45 by means of a throttle 43'.

The apparatus operates as follows: The leakage flow flowing over the annular projecting control face portion 31*a* from the high pressure control port 17 into the recesses 42, flows through throttle 43' into the low pressure discharge conduit 44. The pressure developing in recesses 42 acts through the connecting conduit 37 on the end face 36 of valve slide 35. If, for example, due to tilting of the cylinder block 9 for the above explained reasons, the leakage flow into recesses 42 transmitted by the connecting conduit 37 into the end chamber of valve slide 35 increases, valve slide 35 is displaced against the action of spring 34 and connects the pressure chamber in positioning cylinder 29 with the high pressure conduit 30' so that the positioning piston 28 is moved and pressed against the tilted cylinder block 9 to tilt the same back to its normal position so that the leakage flow into recesses 42 is reduced.

In the event that the leakage flow drops below a certain volume, the control valve slide 35 is operated by spring 34 to throttle and finally close the flow into positioning cylinder 29 so that the pressure acting on positioning piston 28 is reduced by leakage so that the cylinder block can again move toward the tilted position.

If it is intended to use the pump also in the opposite direction of rotation, corresponding recesses 42 and connecting conduits must be associated with control port 18. The respective connections with the connecting conduit 37 have to include check valves which close communication with the respective low pressure port.

Recesses corresponding to recesses 42 may be arranged in any angular position in which tilting of the cylinder block 9 is to be prevented.

The equilibrium of the moments acting on the cylinder block 9 is disturbed when the length of the control port for any cylinder 12, which is subjected to the pressure prevailing in the respective cylinder, changes during rotation. This can be substantially avoided by providing a circular groove 47 in the cylinder block end face 14, the groove being divided by face portions 46 into curved groove portions whose number is the same as the number of the cylinder ports 21*a*. Each cylinder port 21*a* opens into one groove portion, respectively, and the radial width of the groove and groove portions is equal to the radial width of the control ports. The control ports 21*a* are, of course, located along a circle having the same radius as the groove 47.

It will be understood that each of the elements described above, or two or more together, may also find a useful application in other types of cylinder block positioning arrangements for a hydraulic machine differing from the types described above.

While the invention has been illustrated and described as embodied in a cylinder block positioning arrangement compensating a tilting of the cylinder block by tilting moments produced by hydraulic pressure forces, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore such adaptations should and are intended to be comprehended within the meaning and range of equivalence of the following claims.

What is claimed as new and desired to be protected by Letters Patent is set forth in the appended claims.

I claim:

1. In a hydraulic axial piston machine, a combination comprising a rotary cylinder block mounted for angular displacement about an axis of rotation and having a longitudinal axis which is intended to coincide with said axis of rotation, a block end face normal to said longitudinal axis, and a circumferential surface adjacent said end face, said cylinder block being provided with cylinders located along a circle concentric with said longitudinal axis and having a first radius, and cylinder ports communicating with said cylinders, respectively, and located on said block end face along a circle concentric with said longitudinal axis and having a second radius smaller than said first radius; a stationary body having a control face normal to said axis of rotation and being in sliding contact with said block end face, said stationary body being provided with high pressure conduit means and low pressure conduit means respectively opening in a high pressure control port and in a low pressure control port on said control face, said control ports being located along a circle concentric with said axis of rotation and having said second radius so as to communicate with said cylinder ports, whereby a tilting moment acts on said cylinder block in a sense tending to incline said longitudinal axis with respect to said axis of rotation and said block end face with respect to said control face; and positioning means for counteracting said tilting moment and the inclination of said longitudinal axis with respect to said axis of rotation including a positioning cylinder member and a positioning piston member in said positioning cylinder member, one of said positioning members engaging a portion of said circumferential surface of said cylinder block axially adjacent said block end face, and being movable in a direction normal to said axis of rotation toward and away from the same whereby to restore the coincidence of said longitudinal axis with said axis of rotation.

2. A hydraulic machine as claimed in claim 1 wherein said control face has an annular face portion having a radial width less than the outer radius of said control face and greater than the inner radius of said control face, and projecting from the remaining inner and outer portions of said control face so that said block end face is in sliding contact only with said annular face portion; and wherein said control ports open on said annular face portion.

3. A hydraulic machine as claimed in claim 1 further comprising conduit means connecting said high pressure conduit means with said positioning cylinder member.

4. A hydraulic machine as claimed in claim 1 wherein said stationary body has connecting conduit means connecting said control face with said positioning cylinder member so that said one movable positioning member is operated by leakage flow.

5. A hydraulic machine as claimed in claim 4 wherein said control face has at least one recess radially inward of said high pressure control port for receiving leakage flow; and wherein said connecting conduit means are connected with said recess.

6. A hydraulic machine as claimed in claim 1 wherein said one movable positioning member includes a slide shoe mounted for angular movement and engaging said cylinder block.

7. In a hydraulic axial piston machine, a combination comprising a rotary cylinder block having an axis, a block end face, cylinders located along a circle concentric with said axis and having a first radius, and cylinder ports communicating with said cylinders, respectively, and located on said block end face along a circle concentric with said axis and having a second radius smaller than said first radius; positioning means including a positioning cylinder member, and a positioning piston member in said positioning cylinder member, one of said positioning members engaging said cylinder block near said block end face, and being movable in radial direction toward and away from said axis; and a stationary body having a control face in sliding contact with said block end face, high pressure conduit means and low pressure conduit means opening in a high pressure control port and in a low pressure control port on said control face located along a circle concentric with said axis and having said second radius so as to communicate with said cylinder ports whereby a tilting moment acts on said cylinder block to tilt said cylinder block and said block end face relative to said control face with attendant leakage flow, at least one recess radially inward of said high pressure control port for receiving said leakage flow, and connecting conduit means connecting said recess with said positioning cylinder member so that said one movable positioning member is operated by said leakage flow for compensating said tilting moment so that said block end face is parallel to said control face, said connecting conduit means further comprising control valve means including a valve slide operated by said leakage flow to move to a control position connecting said high pressure conduit means with said positioning cylinder for operating said one movable positioning member.

8. A hydraulic machine as claimed in claim 7 wherein said stationary body has a low pressure discharge passage, and a throttle connecting said recess with said discharge passage so that said valve slide is not operated at low leakage flow.

9. A hydraulic machine as claimed in claim 7 wherein said control valve means includes spring means acting on said valve slide to interrupt the flow from said high pressure conduit means to said positioning cylinder when the leakage flow is small.

10. A hydraulic machine as claimed in claim 7 wherein said control valve means include a control cylinder having a first inlet connected with said connecting conduit at one end, a second inlet connected with said high pressure conduit means, a first outlet connected with said positioning cylinder, and a second outlet connected with an open discharge space; and wherein said valve slide has piston portions forming first and second annular chambers, and first and second end chambers in said control cylinder, said first inlet opening into said first end chamber, said second inlet opening into said first annular chamber, said first and second outlets being connected and disconnected from said first and second annular chambers depending on the position of said valve slide.

11. A hydraulic machine as claimed in claim 10, wherein said control valve means includes a spring located in said second end chamber of said control cylinder and acting on said valve slide to oppose the pressure in said first end chamber; and wherein said positioning means includes a spring in said positioning cylinder member urging said one movable positioning member against said cylinder block.

12. In a hydraulic axis piston machine, a combination comprising a rotary cylinder block having an axis, a block end face having a circular groove and means dividing said circular groove into curved groove portions, cylinders located along a circle concentric with said axis and having a first radius, cylinder ports of part-circular configuration, communicating with said cylinders, respectively, located on said block end face along a circle concentric with said axis and having a second radius smaller than said first radius and opening into said curved groove portions, respectively; a stationary body having a control face in sliding contact with said block end face, high pressure conduit means and low pressure conduit means opening in a high pressure control port and in a low pressure control port on said control face, said control ports having a radial width equalling the radial width of said curved groove portions and being located along a circle concentric with said axis and having said second radius so as to communicate with said cylinder ports, whereby a tilting moment acts on said cylinder block to tilt said cylinder block and said block end face relative to said control face; and positioning means including a positioning cylinder member, and a positioning piston member in said positioning cylinder member, one of said positioning members engaging said cylinder block near said block end face, and being movable in radial direction toward and away from said axis for compensating said tilting moment so that said block end face is parallel to said control face.

13. In a hydraulic axial piston machine, a combination comprising a rotary cylinder block having an axis, a block end face, cylinders located along a circle concentric with said axis and having a first radius, cylinder ports communicating with said cylinders, respectively, and located on said block end face along a circle concentric with said axis and having a second radius smaller than said first radius; a stationary body having a control face in sliding contact with said block end face and formed with at least one recess for receiving leakage flow, high pressure conduit means and low pressure conduit means opening in a high pressure control port and in a low pressure control port on said control face, located along a circle concentric with said axis and having said second radius so as to communicate with said cylinder ports, whereby a tilting moment acts on said cylinder block to tilt said clyinder block and said block end face relative to said control face; and positioning means including a positioning cylinder member, and a positioning piston member in said positioning cylinder member, one of said positioning members engaging said cylinder block near said block end face, and being movable in radial direction toward and away from said axis for compensating said tilting moment so that said block end face is parallel to said control face, said stationary member further comprising control valve means, connecting conduit means connecting said recess with said control vavle means for operating the same, a discharge passage, a throttle connecting said recess with said discharge passage, a high pressure conduit connecting said high pressure conduit means with said control valve means, conduit means connecting said control valve means with said positioning cylinder means; and wherein said control valve means is operated by high leakage flow into said recess to connect said high pressure conduit with said positioning cylinder member for operating said one movable positioning member, while low leakage into said recess is discharged through said throttle and said discharge conduit.

14. In a hydraulic axial piston machine, a combination comprising a rotary cylinder block mounted for angular displacement about an axis of rotation and having a longitudinal axis which is intended to coincide with said axis of rotation, a block end face normal to said longitudinal axis, and a circumferential surface adjacent said end face, said cylinder block being provided with cylinders located along a circle concentric with said longitudinal axis and having a first radius, and cylinder ports communicating with said cylinders, respectively, and located on said block end face along a circle concentric with said longitudinal axis and having a second radius smaller than said first radius; a stationary body having a control face normal to said axis of rotation and being in sliding contact with said block end face, said stationary body being provided with high-pressure conduit means and low-pressure conduit means respectively opening in a part-circular high-pressure control port and in a part-circular low-pressure control port on said control face, said control ports having respective spaced ends and being located along a circle concentric with said axis of rotation and having said second radius so as to communicate with said cylinder ports, whereby a tilting moment acts on said cylinder block in a sense tending to incline said longitudinal axis with respect to said axis of rotation and said block end face with respect to said control face, said control face having two recesses located radially inward of said ends of said high-pressure control port for receiving leakage flow; positioning means including a positioning cylinder member and a positioning piston member in said positioning cylinder member, one of said positioning members engaging a portion of said circumferential surface of said cylinder block axially adjacent said block end face, and being movable in a direction normal to said axis of rotation toward and away from the same so as to counteract said tilting moment and the inclination of said longitudinal axis with respect to said axis of rotation whereby to restore the coincidence of said longitudinal axis with said axis of rotation; a conduit connecting said two recesses with one another; and connecting conduit means connecting said conduit with said positioning cylinder member so that said one movable positioning member is operated by leakage flow received in said recesses.

* * * * *